US010337085B2

(12) United States Patent
Yuan et al.

(10) Patent No.: US 10,337,085 B2
(45) Date of Patent: Jul. 2, 2019

(54) DIE CASTING ALUMINUM ALLOY AND PRODUCTION METHOD THEREOF, AND COMMUNICATIONS PRODUCT

(71) Applicant: Huawei Technologies Co., Ltd., Shenzhen (CN)

(72) Inventors: Wenwen Yuan, Munich (DE); Banghong Hu, Shenzhen (CN); Naier Meng, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 533 days.

(21) Appl. No.: 14/731,208

(22) Filed: Jun. 4, 2015

(65) Prior Publication Data

US 2015/0354032 A1 Dec. 10, 2015

(30) Foreign Application Priority Data

Jun. 6, 2014 (CN) ..... 2014 1 0250104

(51) Int. Cl.
*C22C 21/04* (2006.01)
*B22D 21/00* (2006.01)
*C22C 21/02* (2006.01)

(52) U.S. Cl.
CPC ..... *C22C 21/04* (2013.01); *B22D 21/007* (2013.01); *C22C 21/02* (2013.01)

(58) Field of Classification Search
None
See application file for complete search history.

(56) References Cited

U.S. PATENT DOCUMENTS

2013/0307383 A1* 11/2013 Suzuki ..... C22C 21/02 312/223.1
2015/0344992 A1* 12/2015 Oda ..... B22D 27/20 75/684

FOREIGN PATENT DOCUMENTS

| | | | |
|---|---|---|---|
| CN | 201063804 | Y | 5/2008 |
| CN | 101798648 | A | 8/2010 |
| CN | 102108461 | A | 6/2011 |
| CN | 103328668 | A | 9/2013 |
| CN | 103526082 | A | 1/2014 |

OTHER PUBLICATIONS

"Technology Manual; Development, processes and material information for cast components made of aluminum and magnesium," pp. 40-41, KSM Castings Group, Hildesheim, Germany (2013).
Aparicio et al., "Solidification Kinetics of a Near Eutectic Al—Si Alloy, Unmodified and Modified with Sr," Met. Mater. Int., vol. 19, No. 4, pp. 707-715, Kim and Springer, New York, New York (Jul. 10, 2013).
Rongzhang, "Cast Aluminum Alloy," pp. 1-493, Central South University Press, Changsha, China (Sep. 30, 2006).

* cited by examiner

*Primary Examiner* — Xiaowei Su
(74) *Attorney, Agent, or Firm* — Leydig, Voit & Mayer, Ltd.

(57) ABSTRACT

Embodiments of the present invention provide a die casting aluminum alloy, including the following components in percentage by mass: 11.0% to 14.0% of silicon; 0.1% to 0.9% of manganese; 0.1% to 1.0% of magnesium; 0.3% to 1.4% of iron; less than or equal to 0.2% of copper; and aluminum and inevitable impurities. The die casting aluminum alloy has good formability, heat conductivity, and corrosion resistance, and certain mechanical properties, which can avoid problems of a low yield of die-casting fittings, burn-in caused by severe heat emission of a product, corrosion in a coastal environment, assembly difficulties caused by insufficient mechanical properties, severe deformation in a wind load condition, and the like, so as to satisfy requirements of global delivery of complex communications products.

14 Claims, No Drawings

DIE CASTING ALUMINUM ALLOY AND PRODUCTION METHOD THEREOF, AND COMMUNICATIONS PRODUCT

CROSS-REFERENCE TO RELATED APPLICATIONS

This application claims priority to Chinese Patent Application No. 201410250104.8, filed on Jun. 6, 2014, which is hereby incorporated by reference in its entirety.

TECHNICAL FIELD

The present invention relates to the field of aluminum alloy materials, and in particular, to a die casting aluminum alloy and a production method thereof, and a communications product.

BACKGROUND

With development of the communications industry, higher requirements are imposed on reliability of communications products. Communications products are generally delivered to all regions, and need to adapt to global weather and environment, which requires that communications die-casting fittings are corrosion resistant to sea water and acid rain, have good heat dissipation performance to adapt to a thermal shock change, have certain mechanical properties to satisfy wind load fatigue, and the like. In view of satisfying requirements of various comprehensive properties of the communications die-casting fittings, a die-casting base material needs to have characteristics of high heat conductivity, good corrosion resistance, and certain mechanical properties. In addition, generally, the communications die-casting fitting has a complex structure, has a large number of complex thin-wall heat sink fins, high and low bosses, and deep-cavity structures, and therefore, the die-casting base material needs to have good formability. Costs of the base material are also a factor to be considered in large-scale and global delivery. In view of the foregoing requirements, a die casting aluminum alloy is the first choice.

However, it is hard for an existing die casting aluminum alloy to have properties in various aspects, for example, aluminum alloys with three designations, namely, YL102, YL113, and YL117 in Chinese standards, have excellent formability, but poor corrosion resistance, which cannot satisfy requirements of application of the communications die-casting fitting in coastal environment, acid rain, and the like. In die casting aluminum alloys with foreign designations, for example, an European Union standard EN 43400 has poor formability; EN 44300 has excellent formability, and heat conductivity of the EN 44300 also satisfies requirements, but a thread stripping phenomenon often occurs in a process of assembling a complex die-casting fitting because EN 44300 has low rigidity. ADC1 and ADC12 in aluminum alloys with Japanese designations have excellent formability, but low corrosion resistance, especially the ADC12 alloy. Even though surface coating is performed, the complex communications die-casting fitting still cannot be applied to a seaside environment. In view of this, developing a die casting aluminum alloy having high heat conductivity, high corrosion resistance, good formability, and certain mechanical properties currently has become an urgent demand of the communications industry.

SUMMARY

In view of this, a first aspect of embodiments of the present invention provides a die casting aluminum alloy, which has good formability, heat-conducting property, and corrosion resistance, and certain mechanical properties, and is used to resolve a problem in the prior art that the die casting aluminum alloy cannot have good formability, heat-conducting property, corrosion resistance, and mechanical properties.

According to a first aspect, an embodiment of the present invention provides a die casting aluminum alloy, including the following components in percentage by mass:

11.0% to 14.0% of silicon;

0.1% to 0.9% of manganese;

0.1% to 1.0% of magnesium;

0.3% to 1.4% of iron;

less than or equal to 0.2% of copper; and aluminum and inevitable impurities.

In an implementation manner of the present invention, a mass percentage of silicon is specifically 11.5% to 13.5%.

In an exemplary implementation manner of the present invention, the mass percentage of silicon is specifically 13%.

In an implementation manner of the present invention, a mass percentage of copper is specifically less than or equal to 0.15%.

In an exemplary implementation manner of the present invention, the mass percentage of copper is specifically less than or equal to 0.05%.

In an exemplary implementation manner of the present invention, the mass percentage of copper is specifically less than or equal to 0.01%.

In an implementation manner of the present invention, a mass percentage of manganese is specifically 0.3% to 0.7%.

In an exemplary implementation manner of the present invention, the mass percentage of manganese is specifically 0.45%.

In an implementation manner of the present invention, a mass percentage of magnesium is specifically 0.35% to 0.7%.

In an exemplary implementation manner of the present invention, the mass percentage of magnesium is specifically 0.5%.

In an implementation manner of the present invention, a mass percentage of iron is specifically 0.6% to 1.3%.

In an exemplary implementation manner of the present invention, the mass percentage of iron is specifically 0.8%.

In an implementation manner of the present invention, phases in an organization structure of the die casting aluminum alloy include an α-Al phase, an eutectic Si phase, and a second phase, and the second phase is distributed in a grain boundary location or is separated out of the α-Al phase.

In an implementation manner of the present invention, the second phase includes an $Al_3Fe$ phase, a $CuAl_2$ phase, an $Mg_2Si$ phase, an Al—Si—Fe—Mn quaternary compound phase, and an Al—Si—Fe ternary compound phase.

In an implementation manner of the present invention, solution treatment is performed on some of iron, copper, magnesium, and manganese inside the α-Al phase;

silicon forms a binary or multi-component eutectic structure in an aluminum alloy, which improves formability of the alloy, and improves fluidity; and when silicon content is 11.0% to 14.0%, the die casting aluminum alloy is located near an eutectic point, and has good formability;

adding 0.1% to 0.9% of manganese to an aluminum silicon alloy can improve corrosion resistance of the alloy, and deleterious effects of iron can be reduced by improving a form of a Fe-containing phase, so as to achieve an objective of improving strength of the alloy, and improve mechanical properties of the alloy;

due to refining effects on an Si phase, adding 0.1% to 1.0% of magnesium to the aluminum silicon alloy can improve strength and rigidity of the alloy, so as to improve mechanical properties of the alloy;

in the die casting aluminum alloy, iron content being 0.3% to 1.4% can avoid a mold sticking phenomenon of metal, and improve formability of the alloy; and copper content being less than or equal to 0.2% in the die casting aluminum alloy can play a role of enhancing mechanical properties, which ensures good corrosion resistance of the alloy.

The die casting aluminum alloy provided in the first aspect of the embodiments of the present invention has good formability, heat conductivity, and corrosion resistance, and certain mechanical properties. Because co-action of specified content of multiple elements, namely, silicon, manganese, magnesium, iron, and copper balances various properties, a stable crystal structure is formed, so that the die casting aluminum alloy having an excellent integrated property is obtained.

According to a second aspect, an embodiment of the present invention provides a production method of a die casting aluminum alloy, including the following steps:

according to a component ratio of the die casting aluminum alloy, first adding a pure aluminum ingot to a smelting furnace; adding an aluminum silicon alloy, an aluminum copper alloy, an aluminum iron alloy, an aluminum manganese alloy, and an aluminum magnesium alloy for smelting after the aluminum ingot is smelted, and performing die-cast formation after refining and degassing processing, to obtain the die casting aluminum alloy, where the die casting aluminum alloy includes the following components in percentage by mass: 11.0% to 14.0% of silicon; 0.1% to 0.9% of manganese; 0.1% to 1.0% of magnesium; 0.3% to 1.4% of iron; less than or equal to 0.2% of copper; and aluminum and inevitable impurities.

The production method of the die casting aluminum alloy provided in the second aspect of the embodiments of the present invention has a simple process, and the die casting aluminum alloy obtained through production has good formability, heat conductivity, and corrosion resistance, and certain mechanical properties.

A third aspect of the embodiments of the present invention provides a communications product, including a housing, and a power supply circuit and a functional circuit that are located in the housing, where the power supply circuit supplies power to the functional circuit, and the housing is obtained through die-casting by using the die casting aluminum alloy provided in the first aspect of the embodiments of the present invention.

The communications product provided in the third aspect of the embodiments of the present invention has good formability, heat conductivity, and corrosion resistance, and certain mechanical properties, which can satisfy requirements of global delivery.

Some advantages of the embodiments of the present invention are described in the following specification, and some are obvious according to the specification, or can be learned according to implementation of the embodiments of the present invention.

DESCRIPTION OF EMBODIMENTS

The following descriptions are exemplary implementation manners of the present invention. It should be noted that a person of ordinary skill in the art may make certain improvements and polishing without departing from the principle of the present invention and the improvements and polishing shall fall within the protection scope of the present invention.

A first aspect of embodiments of the present invention provides a die casting aluminum alloy, which has good formability, heat-conducting property, and corrosion resistance, and certain mechanical properties, and is used to resolve a problem in the prior art that the die casting aluminum alloy cannot have good formability, heat-conducting property, corrosion resistance, and mechanical properties.

According to the first aspect, an embodiment of the present invention provides a die casting aluminum alloy, including the following components in percentage by mass:

11.0% to 14.0% of silicon;

0.1% to 0.9% of manganese;

0.1% to 1.0% of magnesium;

0.3% to 1.4% of iron;

less than or equal to 0.2% of copper; and aluminum and inevitable impurities.

In an implementation manner of the present invention, a mass percentage of silicon is specifically 11.5% to 13.5%.

In an exemplary implementation manner of the present invention, the mass percentage of silicon is specifically 13%.

In an implementation manner of the present invention, a mass percentage of copper is specifically less than or equal to 0.15%.

In an exemplary implementation manner of the present invention, the mass percentage of copper is specifically less than or equal to 0.05%.

In an exemplary implementation manner of the present invention, the mass percentage of copper is specifically less than or equal to 0.01%.

In an implementation manner of the present invention, a mass percentage of manganese is specifically 0.3% to 0.7%.

In an exemplary implementation manner of the present invention, the mass percentage of manganese is specifically 0.45%.

In an implementation manner of the present invention, a mass percentage of magnesium is specifically 0.35% to 0.7%.

In an exemplary implementation manner of the present invention, the mass percentage of magnesium is specifically 0.5%.

In an implementation manner of the present invention, a mass percentage of iron is specifically 0.6% to 1.3%.

In an exemplary implementation manner of the present invention, the mass percentage of iron is specifically 0.8%.

In an implementation manner of the present invention, the die casting aluminum alloy includes the following components in percentage by mass: 11.5% to 13.5% of silicon; 0.3% to 0.7% of manganese; 0.35% to 0.7% of magnesium; 0.6% to 1.3% of iron; less than or equal to 0.15% of copper; and aluminum and inevitable impurities.

In an implementation manner of the present invention, the die casting aluminum alloy includes the following components in percentage by mass: 13% of silicon; 0.45% of manganese; 0.5% of magnesium; 0.8% of iron; 0.049% of copper; and aluminum and inevitable impurities.

In an implementation manner of the present invention, the die casting aluminum alloy includes the following components in percentage by mass: 13% of silicon; 0.45% of manganese; 0.5% of magnesium; 0.8% of iron; 0.006% of copper; and t aluminum and inevitable impurities.

In an implementation manner of the present invention, phases in an organization structure of the die casting aluminum alloy include an α-Al phase, an eutectic Si phase, and a second phase, and the second phase is distributed in a grain boundary location or is separated out of the α-Al phase.

In an implementation manner of the present invention, the second phase includes an $Al_3Fe$ phase, a $CuAl_2$ phase, an $Mg_2Si$ phase, an Al—Si—Fe—Mn quaternary compound phase, and an Al—Si—Fe ternary compound phase.

In an implementation manner of the present invention, solution treatment is performed on some of iron, copper, magnesium, and manganese inside the α-Al phase;

silicon forms a binary or multi-component eutectic structure in an aluminum alloy, which improves formability of the alloy, and improves fluidity, and when silicon content is 11.0% to 14.0%, the die casting aluminum alloy is located near an eutectic point, and has good formability;

adding 0.1% to 0.9% of manganese to an aluminum silicon alloy can improve corrosion resistance of the alloy, and deleterious effects of iron can be reduced by improving a form of a Fe-containing phase, so as to achieve an objective of improving strength of the alloy, and improve mechanical properties of the alloy;

due to refining effects on an Si phase, adding 0.1% to 1.0% of magnesium to the aluminum silicon alloy can improve strength and rigidity of the alloy, so as to improve mechanical properties of the alloy;

in the die casting aluminum alloy, iron content being 0.3% to 1.4% can avoid a mold sticking phenomenon of metal, and improve formability of the alloy; and copper content being less than or equal to 0.2% in the die casting aluminum alloy can play a role of enhancing mechanical properties, which ensures good corrosion resistance of the alloy.

The die casting aluminum alloy provided in the first aspect of the embodiments of the present invention has good formability, heat conductivity, corrosion resistance, and mechanical properties. Because combined action of specific content of multiple elements, namely, silicon, manganese, magnesium, iron, and copper balances various properties, a stable crystal structure is formed, so that the die casting aluminum alloy having an excellent integrated property is obtained.

According to a second aspect, an embodiment of the present invention provides a production method of a die casting aluminum alloy, including the following steps:

according to a component ratio of the die casting aluminum alloy, first adding a pure aluminum ingot to a smelting furnace, adding an aluminum silicon alloy, an aluminum copper alloy, an aluminum iron alloy, an aluminum manganese alloy, and an aluminum magnesium alloy for smelting after the aluminum ingot is smelted, and performing die-cast formation after refining and degassing processing, to obtain the die casting aluminum alloy, where the die casting aluminum alloy includes the following components in percentage by mass: 11.0% to 14.0% of silicon; 0.1% to 0.9% of manganese; 0.1% to 1.0% of magnesium; 0.3% to 1.4% of iron; less than or equal to 0.2% of copper; and aluminum and inevitable impurities.

The production method of the die casting aluminum alloy in the present invention uses an existing conventional process, and further includes operations such as conventional removal of impurities. Parameters of various processes are not specifically limited in the present invention.

In an implementation manner of the present invention, a mass percentage of silicon is specifically 11.5% to 13.5%.

In an exemplary implementation manner of the present invention, the mass percentage of silicon is specifically 13%.

In an implementation manner of the present invention, a mass percentage of copper is specifically less than or equal to 0.15%.

In an exemplary implementation manner of the present invention, the mass percentage of copper is specifically less than or equal to 0.05%.

In an exemplary implementation manner of the present invention, the mass percentage of copper is specifically less than or equal to 0.01%.

In an implementation manner of the present invention, a mass percentage of manganese is specifically 0.3% to 0.7%.

In an exemplary implementation manner of the present invention, the mass percentage of manganese is specifically 0.45%.

In an implementation manner of the present invention, a mass percentage of magnesium is specifically 0.35% to 0.7%.

In an exemplary implementation manner of the present invention, the mass percentage of magnesium is specifically 0.5%.

In an implementation manner of the present invention, a mass percentage of iron is specifically 0.6% to 1.3%.

In an exemplary implementation manner of the present invention, the mass percentage of iron is specifically 0.8%.

In an implementation manner of the present invention, the die casting aluminum alloy includes the following components in percentage by mass: 11.5% to 13.5% of silicon; 0.3% to 0.7% of manganese; 0.35% to 0.7% of magnesium; 0.6% to 1.3% of iron; less than or equal to 0.15% of copper; and aluminum and inevitable impurities.

In an implementation manner of the present invention, the die casting aluminum alloy includes the following components in percentage by mass: 13% of silicon; 0.45% of manganese; 0.5% of magnesium; 0.8% of iron; 0.049% of copper; and the others being aluminum and inevitable impurities.

In an implementation manner of the present invention, the die casting aluminum alloy includes the following components in percentage by mass: 13% of silicon; 0.45% of manganese; 0.5% of magnesium; 0.8% of iron; 0.006% of copper; and the others being aluminum and inevitable impurities.

In an implementation manner of the present invention, phases in an organization structure of the die casting aluminum alloy include an α-Al phase, an eutectic Si phase, and a second phase, and the second phase is distributed in a grain boundary location or is separated out of the α-Al phase.

In an implementation manner of the present invention, the second phase includes an $Al_3Fe$ phase, a $CuAl_2$ phase, an $Mg_2Si$ phase, an Al—Si—Fe—Mn quaternary compound phase, and an Al—Si—Fe ternary compound phase.

In an implementation manner of the present invention, solution treatment is performed on some of iron, copper, magnesium, and manganese inside the α-Al phase.

The production method of the die casting aluminum alloy provided in the second aspect of the embodiments of the present invention has a simple process, and the die casting aluminum alloy obtained through production has good formability, heat conductivity, and corrosion resistance, and certain mechanical properties.

A third aspect of the embodiments of the present invention provides a communications product, including a housing, and a power supply circuit and a functional circuit that are located in the housing, where the power supply circuit supplies power to the functional circuit, and the housing is obtained through die-casting by using the die casting aluminum alloy provided in the first aspect of the embodiments of the present invention.

In the communications product, other components that can be made of an aluminum alloy may also be obtained through die-casting by using the die casting aluminum alloy in the embodiments of the present invention, such as a handle, a maintenance cavity cover, a slide rail, a rotating shaft, and a supporting piece.

The communications product provided in the third aspect of the embodiments of the present invention has good formability, heat conductivity, and corrosion resistance, and certain mechanical properties, and high stability, which can satisfy requirements of global delivery.

The embodiments of the present invention are further described below by using multiple embodiments. The embodiments of the present invention are not limited to the following specific embodiments. Implementation may be appropriately modified without changing the scope of the independent claims.

Embodiment 1

A die casting aluminum alloy includes the following components in percentage by mass: 11.0% to 14.0% of silicon; 0.1% to 0.9% of manganese; 0.1% to 1.0% of magnesium; 0.3% to 1.4% of iron; less than or equal to 0.2% of copper; and the others being aluminum and inevitable impurities.

The die casting aluminum alloy having composition in this embodiment is die-cast into a complex thin-wall communications housing, and a production method of the housing includes the following steps:

according to a component ratio of the die casting aluminum alloy, first adding a pure aluminum ingot to a smelting furnace, adding an aluminum silicon alloy, an aluminum copper alloy, an aluminum iron alloy, an aluminum manganese alloy, and an aluminum magnesium alloy for smelting after the aluminum ingot is smelted, and performing die-cast formation after refining and degassing processing, to obtain the thin-wall communications housing.

The interior of the die casting aluminum alloy includes an α-Al phase, an eutectic Si phase, and a second phase, the second phase is distributed in a grain boundary location or is separated out of the α-Al phase, and the second phase includes an $Al_3Fe$ phase, a $CuAl_2$ phase, an $Mg_2Si$ phase, an Al—Si—Fe—Mn quaternary compound phase, and an Al—Si—Fe ternary compound phase. In addition, solution treatment is performed on some of iron, copper, magnesium, and manganese inside the α-Al phase.

Adding 11.0% to 14.0% of silicon can improve the formability of the alloy and improve fluidity. Adding 0.1% to 0.9% of manganese can improve corrosion resistance of the alloy, and deleterious effects of iron can be reduced by improving a form of a Fe-containing phase, so as to achieve an objective of improving strength of the alloy, and reduce occurrence of a mold sticking phenomenon. Because of refining effects on an Si phase, adding 0.1% to 1.0% of magnesium can improve strength and rigidity of the alloy. In the die casting aluminum alloy, iron content being 0.3% to 1.4% can avoid a mold sticking phenomenon of metal. Adding less than or equal to 0.2% of copper can play a role of enhancing mechanical properties.

Embodiment 2

A die casting aluminum alloy includes the following components in percentage by mass: 13% of silicon; 0.45% of manganese; 0.5% of magnesium; 0.8% of iron; 0.049% of copper; and the others being aluminum and inevitable impurities.

The die casting aluminum alloy having composition in this embodiment is die-cast into a complex thin-wall communications housing according to the method of Embodiment 1.

Embodiment 3

A die casting aluminum alloy includes the following components in percentage by mass: 13% of silicon; 0.45% of manganese; 0.5% of magnesium; 0.8% of iron; 0.006% of copper; and the others being aluminum and inevitable impurities.

The die casting aluminum alloy having composition in this embodiment is die-cast into a complex thin-wall communications housing according to the method of Embodiment 1.

Embodiment 4

A die casting aluminum alloy includes the following components in percentage by mass: 13% of silicon; 0.45% of manganese; 0.5% of magnesium; 0.8% of iron; 0.19% of copper; and the others being aluminum and inevitable impurities.

The die casting aluminum alloy having composition in this embodiment is die-cast into a complex thin-wall communications housing according to the method of Embodiment 1.

Embodiment 5

A die casting aluminum alloy includes the following components in percentage by mass: 11% of silicon; 0.1% of manganese; 0.1% of magnesium; 0.3% of iron; 0.05% of copper; and the others being aluminum and inevitable impurities.

The die casting aluminum alloy having composition in this embodiment is die-cast into a complex thin-wall communications housing according to the method of Embodiment 1.

Embodiment 6

A die casting aluminum alloy includes the following components in percentage by mass: 13% of silicon; 0.45% of manganese; 0.5% of magnesium; 0.8% of iron; 0.15% of copper; and the others being aluminum and inevitable impurities.

The die casting aluminum alloy having composition in this embodiment is die-cast into a complex thin-wall communications housing according to the method of Embodiment 1.

Embodiment 7

A die casting aluminum alloy includes the following components in percentage by mass: 14% of silicon; 0.9% of manganese; 1.0% of magnesium; 1.4% of iron; 0.01% of copper; and the others being aluminum and inevitable impurities.

The die casting aluminum alloy having composition in this embodiment is die-cast into a complex thin-wall communications housing according to the method of Embodiment 1.

Effect embodiments: To effectively support beneficial effects of the embodiments of the present invention, effect embodiments are provided as follows, which are used to evaluate properties of the product provided in the embodiments of the present invention.

1. Formability

A complex thin-wall communications housing is obtained by die-casting each of the following three alloys: the alloy in Embodiment 1 of the present invention, a 43400 alloy, and an ADC12 alloy. When formability of the alloy is not good, a defect of a short shot easily occur in a thin-wall heat sink fin. According to existing statistics, 30 die-casting fittings are continuously manufactured by using each alloy, and a statistics result of a largest three-dimensional size of each short shot feature on 25 heat sink fins is shown in Table 1. The largest three-dimensional size is described in three types: ≥0.5 mm, ≤1.0 mm; >1.0 mm, ≤3 mm; >3 mm.

TABLE 1

Statistics of short shot features of die-casting fittings made of different materials

| Material | Total quantity of defects | Ratio of a total quantity of defects between each alloy and 43400 alloy | Short shot that is ≥0.5 mm and ≤1.0 mm Quantity | Short shot that is >1.0 mm and ≤3 mm Quantity | Short shot that is >3 mm Quantity |
|---|---|---|---|---|---|
| 43400 | 243 | — | 75 | 138 | 30 |
| ADC12 | 201 | 17% | 90 | 90 | 21 |
| Embodiment 1 | 171 | 30% | 63 | 81 | 27 |

The statistics result of Table 1 indicates that, formability of the alloy in Embodiment 1 of the present invention is not lower than that of the widely used die casting aluminum alloy ADC12, and is superior to that of the European Union standard die casting aluminum alloy 43400.

2. Heat Conductivity

Heat conductivity of the alloy in Embodiment 2 of the present invention is tested, differences between heat conductivity of the alloy in Embodiment 2 of the present invention and heat conductivity of an existing alloy are compared, and results are shown in Table 2. Heat conductivity is tested by using a hot disk thermal analyzer according to a hot disk principle, and a sample size is 50×50×25 mm.

TABLE 2

Comparison of heat conductivity of various alloys

| Alloy designation | Heat conductivity (w/mk) |
|---|---|
| ADC12 | 92 |
| YL102 | 126 |
| 43400 | 148 |
| Embodiment 2 | 144 |

3. Corrosion Resistance

Corrosion resistance of the alloys in Embodiment 2 to Embodiment 4 of the present invention is tested, differences between corrosion resistance of the alloys in Embodiment 2 to Embodiment 4 of the present invention and corrosion resistance of an existing alloy are compared, and results are shown in Table 3. Corrosion resistance of an alloy is indicated by using a corrosion rate, a testing method of the corrosion rate is based on the standard GB/T19292.4 and the standard GB/T 16545, and a sample size is 120×100×5 mm. To eliminate impact of fringe effects, periphery edges of a testing sample for testing the corrosion rate are covered by adhesive tapes. After neutral salt spray test is performed for 300 h, an average corrosion rate is calculated according to a change of weights of the salt spray before and after the test.

TABLE 3

Comparison of corrosion rates of various alloys

| Alloy designation | Corrosion rate (mg/(dm$^2$ × d)) |
|---|---|
| ADC12 | 34.0 |
| YL102 | 25.0 |
| 43400 | 10.6 |
| Embodiment 2 | 9.5 |
| Embodiment 3 | 3.7 |
| Embodiment 4 | 16.2 |

The result of Table 3 indicates that heat conductivity and the corrosion rate of the alloy in the embodiments of the present invention are equivalent to those of the 43400 alloy, and are superior to those of the ADC12 alloy and the YL102 alloy.

4. Mechanical Properties

A communications housing product is obtained by die-casting each of the following alloys: the alloys in Embodiment 5 to Embodiment 7 of the present invention, the ADC12 alloy, the YL102 alloy, and the 43400 alloy, a standard tensile mechanical test piece is cut from the product according to requirements of GB/T 228, and mechanical properties are tested on a tensile mechanical testing machine, and results are shown in Table 4.

TABLE 4

Mechanical properties of various alloys

| Alloy designation | Tensile strength (MPa) | Elongation rate (%) | Rigidity (HBW) |
|---|---|---|---|
| ADC12 | 260 | 1.8 | 92 |
| YL102 | 235 | 2.3 | 70 |
| 43400 | 242 | 2.2 | 85 |
| Embodiment 5 | 226 | 2.4 | 78 |
| Embodiment 6 | 239 | 1.9 | 85 |
| Embodiment 7 | 246 | 1.3 | 87 |

The results of Table 4 indicate that, compared with a commonly used die casting aluminum alloy, the die casting aluminum alloy of the present invention has certain mechanical properties. Rigidity of the die casting aluminum alloy of the present invention is higher than that of the YL102 alloy, which can effectively prevent threads of a die-casting fitting from malfunctioning in a life cycle.

It can be learned from the foregoing that, formability, heat conductivity, and corrosion resistance of a die casting aluminum alloy obtained according to the embodiments of the present invention are excellent, and the die casting aluminum alloy has certain mechanical properties, which resolves a problem in the prior art that a die casting aluminum alloy cannot have good formability, heat-conducting property, corrosion resistance, and mechanical properties. Therefore, occurrence of problems of a low yield of die-casting fittings, burn-in caused by severe heat emission of a product, corrosion in a coastal environment, assembly difficulties caused by insufficient mechanical properties, severe deformation in a wind load condition, and the like, so as to satisfy requirements of global delivery of complex communications products.

What is claimed is:

1. A die casting aluminum alloy consisting of the following components in percentage by mass:

13.5% to 14.0% of silicon;

0.1% to 0.9% of manganese;

0.1% to 1.0% of magnesium;

0.3% to 1.4% of iron; and less than or equal to 0.2% of copper and greater than 0% copper, and a balance being aluminum and inevitable impurities.

2. The die casting aluminum alloy according to claim 1, wherein a mass percentage of copper is less than or equal to 0.15% and greater than 0%.

3. The die casting aluminum alloy according to claim 2, wherein the mass percentage of copper is less than or equal to 0.05% and greater than 0%.

4. The die casting aluminum alloy according to claim 3, wherein the mass percentage of copper is less than or equal to 0.01% and greater than 0%.

5. The die casting aluminum alloy according to claim 1, wherein a mass percentage of manganese is 0.3% to 0.7%.

6. The die casting aluminum alloy according to claim 5, wherein the mass percentage of manganese is 0.45%.

7. The die casting aluminum alloy according to claim 1, wherein a mass percentage of magnesium is 0.35% to 0.7%.

8. The die casting aluminum alloy according to claim 7, wherein the mass percentage of magnesium is 0.5%.

9. The die casting aluminum alloy according to claim 1, wherein a mass percentage of iron is 0.6% to 1.3%.

10. The die casting aluminum alloy according to claim 9, wherein the mass percentage of iron is 0.8%.

11. The die casting aluminum alloy according to claim 1, wherein phases in an organization structure of the die casting aluminum alloy comprise an α-Al phase, an eutectic Si phase, and a second phase, and the second phase is distributed in a grain boundary location of the α-Al phase.

12. The die casting aluminum alloy according to claim 11, wherein the second phase comprises an $Al_3Fe$ phase, a $CuAl_2$ phase, an $Mg_2Si$ phase, an Al—Si—Fe—Mn quaternary compound phase, and an Al—Si—Fe ternary compound phase.

13. A production method of a die casting aluminum alloy, the method comprising the following:

according to a component ratio of the die casting aluminum alloy, first adding a pure aluminum ingot to a smelting furnace, adding an aluminum silicon alloy, an aluminum copper alloy, an aluminum iron alloy, an aluminum manganese alloy, and an aluminum magnesium alloy for smelting after the aluminum ingot is smelted, and performing die-cast formation after refining and degassing processing, to obtain the die casting aluminum alloy, wherein the die casting aluminum alloy consists of the following components in percentage by mass: 13.5% to 14.0% of silicon; 0.1% to 0.9% of manganese; 0.1% to 1.0% of magnesium; 0.3% to 1.4% of iron; and less than or equal to 0.2% of copper and greater than 0% copper, and a balance being aluminum and inevitable impurities.

14. A communications product comprising a housing, and a power supply circuit and a functional circuit located in the housing, wherein the power supply circuit supplies power to the functional circuit, and the housing is obtained through die-casting by die casting an aluminum alloy, wherein the die cast aluminum alloy consists of the following components in percentage by mass:

13.5% to 14.0% of silicon;

0.1% to 0.9% of manganese;

0.1% to 1.0% of magnesium;

0.3% to 1.4% of iron;

less than or equal to 0.2% of copper and greater than 0% of copper; and a balance being aluminum and inevitable impurities.

* * * * *